US006178888B1

(12) United States Patent
Neyer et al.

(10) Patent No.: US 6,178,888 B1
(45) **Date of Patent: *Jan. 30, 2001**

(54) DETONATOR

(75) Inventors: Barry T. Neyer, Cincinnati; Robert J. Tomasoski, Centerville; John T. Adams, Bellbrook, all of OH (US)

(73) Assignee: EG&G Star City, Inc., Miamisburg, OH (US)

( * ) Notice: Under 35 U.S.C. 154(b), the term of this patent shall be extended for 0 days.

This patent is subject to a terminal disclaimer.

(21) Appl. No.: 09/009,784

(22) Filed: Jan. 20, 1998

(51) Int. Cl.[7] ..... F42B 3/10

(52) U.S. Cl. ..... 102/202.7; 102/202.9; 102/202.14

(58) Field of Search ..... 102/202.7, 202.5, 102/204, 202.9, 202.8, 202.14, 202

(56) References Cited

U.S. PATENT DOCUMENTS

| | | | | |
|---|---|---|---|---|
| H1214 | | 8/1993 | Liva et al. . | |
| H1366 | * | 11/1994 | Bickes, Jr. et al. | 102/202.5 |
| Re. 34,790 | | 11/1994 | Musk . | |
| 3,272,127 | | 9/1966 | Betts et al. . | |
| 3,284,118 | | 11/1966 | Kessler, Jr. . | |
| 3,362,329 | | 1/1968 | Epstein . | |
| 3,528,372 | | 9/1970 | Lewis et al. . | |
| 3,685,392 | | 8/1972 | Platt . | |
| 3,724,383 | | 4/1973 | Gallaghan et al. . | |
| 4,008,945 | | 2/1977 | Schere . | |
| 4,265,511 | | 5/1981 | Nicia et al. . | |
| 4,282,395 | | 8/1981 | Hagemann . | |
| 4,343,242 | | 8/1982 | Welk . | |
| 4,451,115 | | 5/1984 | Nicia et al. . | |
| 4,471,697 | * | 9/1984 | McCormick et al. | 102/202.5 |
| 4,602,565 | * | 7/1986 | MacDonald et al. | 102/202.7 |
| 4,708,060 | | 11/1987 | Bickes, Jr. et al. . | |
| 4,753,508 | | 6/1988 | Meuleman . | |
| 4,807,958 | | 2/1989 | Gunner et al. . | |
| 4,831,933 | | 5/1989 | Nerheim et al. . | |
| 4,862,803 | | 9/1989 | Nerheim et al. . | |
| 4,870,903 | | 10/1989 | Carel et al. . | |
| 4,911,523 | | 3/1990 | Sondergeld et al. . | |
| 4,917,014 | | 4/1990 | Loughry et al. . | |
| 4,930,418 | | 6/1990 | Folsom . | |
| 4,938,137 | * | 7/1990 | Guay | 102/202.7 |
| 5,046,423 | | 9/1991 | Paisley . | |
| 5,094,166 | | 3/1992 | Hendley, Jr. . | |
| 5,094,167 | | 3/1992 | Hendley, Jr. . | |
| 5,104,747 | | 4/1992 | Makino et al. . | |
| 5,138,946 | | 8/1992 | Soltz et al. . | |
| 5,179,246 | | 1/1993 | Betts et al. . | |
| 5,179,247 | | 1/1993 | Hawley . | |
| 5,204,490 | | 4/1993 | Soltz et al. . | |
| 5,206,455 | | 4/1993 | Williams et al. . | |
| 5,247,595 | | 9/1993 | Foldi . | |
| 5,275,106 | * | 1/1994 | Cutting et al. | 102/202.7 |
| 5,317,973 | | 6/1994 | Winaver et al. . | |

(List continued on next page.)

FOREIGN PATENT DOCUMENTS

| | | |
|---|---|---|
| 2 669 724 | 11/1990 | (FR) . |
| 1820180 | 11/1989 | (SU) . |
| WO 98/30862 | 7/1998 | (WO) . |

*Primary Examiner*—Harold J. Tudor
(74) *Attorney, Agent, or Firm*—Kirk Teska; Iandiorio & Teska

(57) ABSTRACT

A detonator with a base portion including opposing electrical leads; an exploding foil initiator on the base portion, the exploding foil initiator including two conductive lands separated by a bridge portion therebetween; and a connecting barrel of a predetermined thickness on the exploding foil initiator for optimizing the spacing between the exploding foil initiator and an explosive charge and for robustly interconnecting the lands of the exploding foil initiator with the electrical leads of the base portion.

17 Claims, 4 Drawing Sheets

U.S. PATENT DOCUMENTS

| | | | | |
|---|---|---|---|---|
| 5,337,387 | | 8/1994 | Kramer . | |
| 5,370,053 | * | 12/1994 | Williams et al. | 102/202.7 |
| 5,370,054 | * | 12/1994 | Reams et al. | 102/202.7 |
| 5,404,820 | | 4/1995 | Hendrix . | |
| 5,431,101 | * | 7/1995 | Arrell, Jr. et al. | 102/202.5 |
| 5,431,104 | * | 7/1995 | Barker | 102/202.7 |
| 5,454,320 | | 10/1995 | Hilden et al. . | |
| 5,520,114 | | 5/1996 | Guimard et al. . | |
| 5,544,585 | | 8/1996 | Duguet . | |
| 5,573,565 | | 11/1996 | Dalton et al. . | |
| 5,621,183 | | 4/1997 | Bailey . | |
| 5,648,634 | | 7/1997 | Avory et al. . | |
| 5,664,040 | | 9/1997 | Kramer et al. . | |
| 5,845,578 | | 12/1998 | Fogle, Jr. . | |
| 5,912,427 | | 6/1999 | Willis et al. . | |
| 5,969,286 | * | 10/1999 | Ward et al. | 102/202.7 |

* cited by examiner

DETONATOR

FIELD OF INVENTION

This invention relates to detonators and in particular to chip slapper type detonators and a method of making the same.

BACKGROUND OF INVENTION

Detonators are used to detonate a primary charge such as an explosive of an air to surface missile. Such detonators are also used to detonate explosives used in other tactical devices, construction explosives, rocket boosters, and the like. These types of detonators must be physically robust and of high integrity. For example, an air to surface missile may be designed to pierce a bunker or other building and only then detonate the primary explosive. The detonator must, therefore, survive the shock of the launch and the impact with the bunker.

Exploding foil initiator ("EFI") detonators, (e.g. "chip slappers"), generally include a ceramic chip upon which is deposited two opposing conductive copper lands which taper to a narrow "bridge" portion therebetween. An electrical current is provided to the lands at the time of initiation and the bridge portion bursts sending a flying plate thereon into an explosive charge which, in turn, detonates the primary charge.

It is convenient to package the chip and the explosive charge within a standard electronics housing such as a "TO" type transistor package including a base with one or more electrical leads and a can which covers the base. Such detonator packaging techniques, however, are fraught with problems.

First, the lead posts of the transistor package base are typically connected to the lands of the chip slapper by individual wires. These wires tend to break in the harsh environment described above and/or burn under the application of high amperage current. In addition, securing the individual wires to the lands and lead posts involves a considerable amount of man hours.

One attempt at overcoming the breakage and burning problems includes interconnecting a number of individual wires from each lead to the lands thereby providing redundancy should any one wire break or burn. This solution, however, only adds to the complexity of the design and entails additional man hours required to interconnect each additional wire.

Another problem with present chip slapper detonator designs is that once the wires are in place, some kind of a mechanical spacer must be placed between the EFI and the explosive charge to optimize the spacing therebetween thereby assuring that the flying plate travels the correct distance before striking the explosive charge. These mechanical spacers must be carefully designed and selected—often involving additional man hours in the fabrication of the detonators resulting in higher costs.

Another important consideration is that the explosive charge must contact the inside top surface of the transistor package can in order to prevent energy losses.

Due to loose manufacturing tolerances, however, the length of the transistor can, the height of the header wall of the transistor base, the thickness of the explosive charge, and the thickness of the chip can all vary. To accommodate these variations and to ensure that the explosive charge is in intimate contact with the inside of the can, the prior art methods included forcing the total height of the components inside the can (e.g., the chip, the spacer, and the explosive charge) to always be greater than the length of the transistor can through the use of a resilient member or members disposed inside the can below the explosive charge. The resilient member is compressed by exerting pressure on the can and the rim of the can is then welded to the flange of the base.

One problem with this prior art design is the complexity involved in choosing the structure and orientation of the resilient member which often includes incorporating two explosive charges separated by the resilient member. And, these additional components add to the cost of the detonators and the man hours required for their fabrication.

SUMMARY OF INVENTION

It is therefore an object of this invention to provide an improved detonator.

It is a further object of this invention to provide such an improved detonator which is physically robust and able to withstand violent environmental conditions.

It is a further object of this invention to provide such an improved detonator which facilitates the use of standard, low tolerance, low cost transistor packages.

It is a further object of this invention to provide such an improved detonator which is easier to fabricate than prior art detonators.

It is a further object of this invention to provide such a detonator which eliminates the need for mechanical spacers and resilient members associated with prior art detonators.

It is a further object of this invention to provide such a detonator which is less expensive to manufacture than prior art detonators.

It is a further object of this invention to provide such an improved detonator which incorporates low resistance electrical connections.

It is a further object of this invention to provide a method of manufacturing a physically robust detonator.

This invention results from the realization that a more physically robust and optimized chip slapper type detonator can be made, not by soldering a number of individual wires between the lead posts of the base and the chip slapper and then using mechanical spacers to separate the flying plate of the chip slapper from the explosive charge, but instead by using a connecting barrel which simultaneously provides the proper spacing between the flying plate and the explosive charge (eliminating the need for mechanical spacers) and which also electrically interconnects the lead posts of the base with the lands of the chip slapper in a robust fashion thereby eliminating the fragile wires used in the design of prior art detonators.

This invention features a detonator comprising a base portion including electrical leads and an exploding foil initiator, typically a chip slapper, on the base portion. The exploding foil initiator includes two conductive lands separated by a bridge portion therebetween. A connecting barrel of a predetermined thickness resides on the exploding foil initiator for optimizing the spacing between the exploding foil initiator and an explosive charge and for robustly interconnecting the lands of the exploding foil initiator with the electrical leads of the base portion. The connecting barrel includes conductive plates extending between the leads of the base portion and the lands of the exploding foil initiator and an opening between the conductive plates. The opening is located over the bridge portion of the exploding foil initiator so that the flying plate of the chip slapper can pass through the opening.

The barrel typically includes a top insulating layer laminated to a bottom conductive layer, the conductive plate formed by etching away the conductive layer from selected portions of the insulating layer. The opening in the conductive plate of the barrel may extend through the top insulating layer. The insulating layer is preferably polyimide and the conductive layer is preferably copper. The conductive plate may have the shape of an annular sector with a broad distal end for simultaneously covering a plurality of leads on one side of the base portion and a tapered proximal end connected to a land of the exploding foil initiator.

The base portion may include a header wall terminating in a support surface. The connecting barrel is preferably disposed between the exploding foil initiator on the support surface and an explosive charge. The detonator may further include a cap having an interior top surface and an enclosure wall extending downward from the interior top surface and surrounding the exploding foil initiator and the explosive charge. The wall terminates in a rim secured at a location along the header wall corresponding to the thickness of the exploding foil initiator, the thickness of the barrel, the thickness of the explosive charge, plus an extra length necessary for welding (approximately 0.020") thereby ensuring that the explosive charge is in communication with the interior top surface of the cap. A YAG laser weld is preferably used to secure the rim of the cap to the header wall. The base portion is typically a TO type transistor header and the cap is typically a TO type transistor can. The base header wall has a height h, the thickness of the exploding foil initiator, the explosive charge, and the barrel totals a height H and, the enclosure wall has a length l preferably greater than height H and less than the sum total of H plus h such that the rim of the enclosure wall is securable at a number of different locations along the header wall.

The invention also features a connecting barrel for an exploding foil initiator type detonator, the connecting barrel comprising a laminate of a predetermined thickness for optimizing the spacing between the exploding foil initiator and an explosive charge responsive to the exploding foil initiator; the laminate including a top insulating layer and a bottom conductive layer configured into a conductive surface for electrically interconnecting the exploding foil initiator with the electrical leads of the detonator in a robust fashion; and an opening in the conductive surface. The opening usually extends through the top insulating layer and the conductive surface may form two discrete conductive plates separated by the opening. Each discrete conductive plate typically forms an annular sector on the insulating layer.

This invention also features a method of manufacturing a detonator, the method comprising securing an exploding foil initiator on a base portion including opposing sets of electrical leads, the exploding foil initiator including two conductive lands separated by a bridge portion therebetween; fabricating a connecting barrel of a predetermined thickness to include two conductive plates separated by an opening; and placing the connecting barrel on the exploding foil initiator such that the two conductive plates each interconnect a set of electrical leads with a conductive land.

The method further includes disposing a explosive charge assembly on the connecting barrel and placing a cap over the explosive charge, the barrel, and the exploding foil initiator. The fabrication step may include providing a laminate having a conductive layer and an insulating layer and etching the conductive layer from selected portions of the conductive layer. Etching usually includes forming two conductive plates each having the shape of an annular sector. The opening is typically formed to extend completely through the barrel. A cap is then secured over the exploding foil initiator, the explosive charge, and the barrel such that the rim of the cap is attached at a location along a header wall of the base portion corresponding to the thickness of the exploding foil initiator, the thickness of the barrel, and the thickness of the explosive charge thereby ensuring that the explosive charge is in communication with an interior top surface of the cap.

DISCLOSURE OF PREFERRED EMBODIMENT

Other objects, features and advantages will occur to those skilled in the art from the following description of a preferred embodiment and the accompanying drawings, in which.

Figure 1:
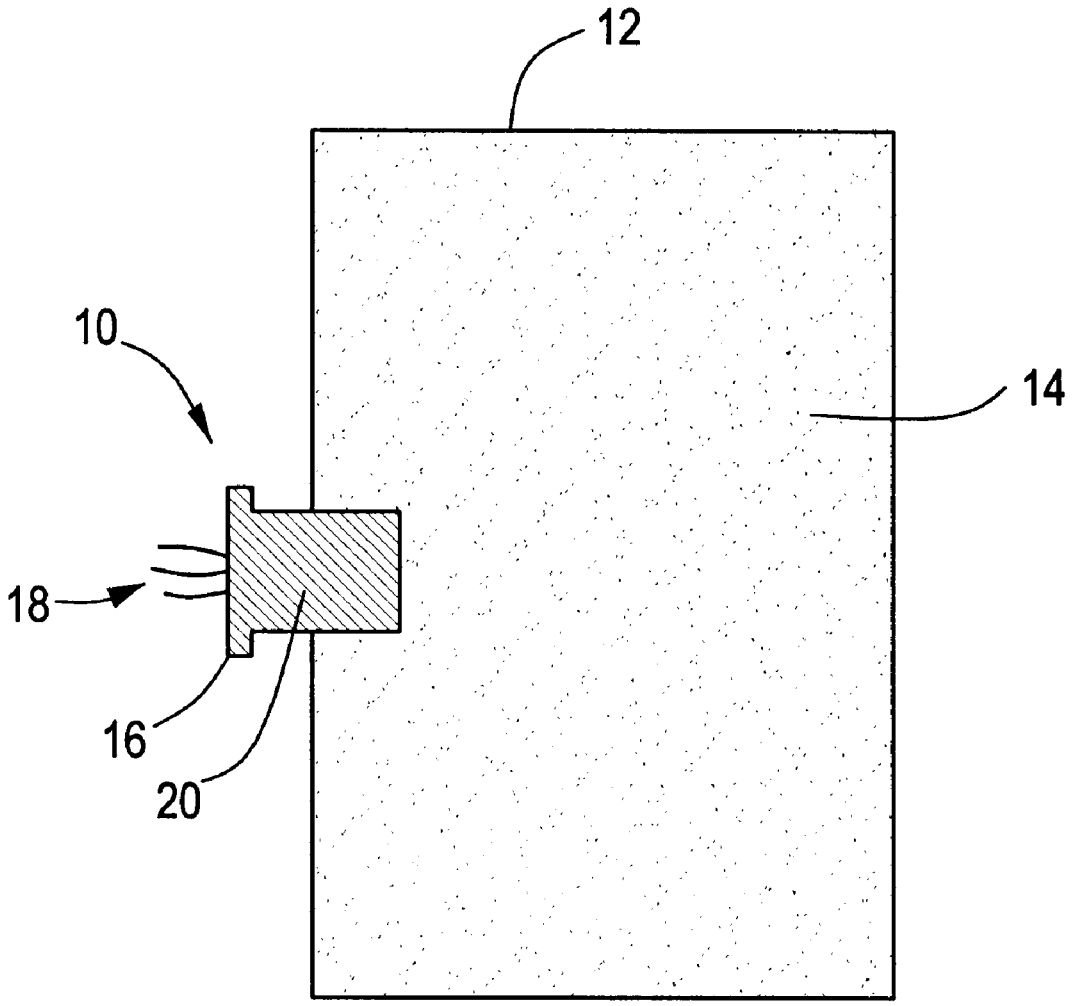
FIG. 1 is a schematic side sectional view of the detonator of this invention in place within a bulkhead containing a primary charge to be detonated.

Detonator 10, FIG. 1, in accordance with this invention is typically an exploding foil initiator chip slapper type detonator as discussed in the Background of the Invention above and may be installed in bulkhead 12 enclosing main charge 14. For example, main charge 14 may be the explosive component of an air to surface missile to be detonated by detonator 10 upon the occurrence of some preestablished criteria such as the impact of the missile with a building or bunker. In accordance with the subject invention, detonator 10 is housed in a standard transistor "TO" type package including base 16 with leads 18 and can or cap 20. Cap 20 may have a diameter of about 0.300 inches and a length of about 0.220 inches. Thus, detonator 10 is relatively small and compact.

Figure 2:
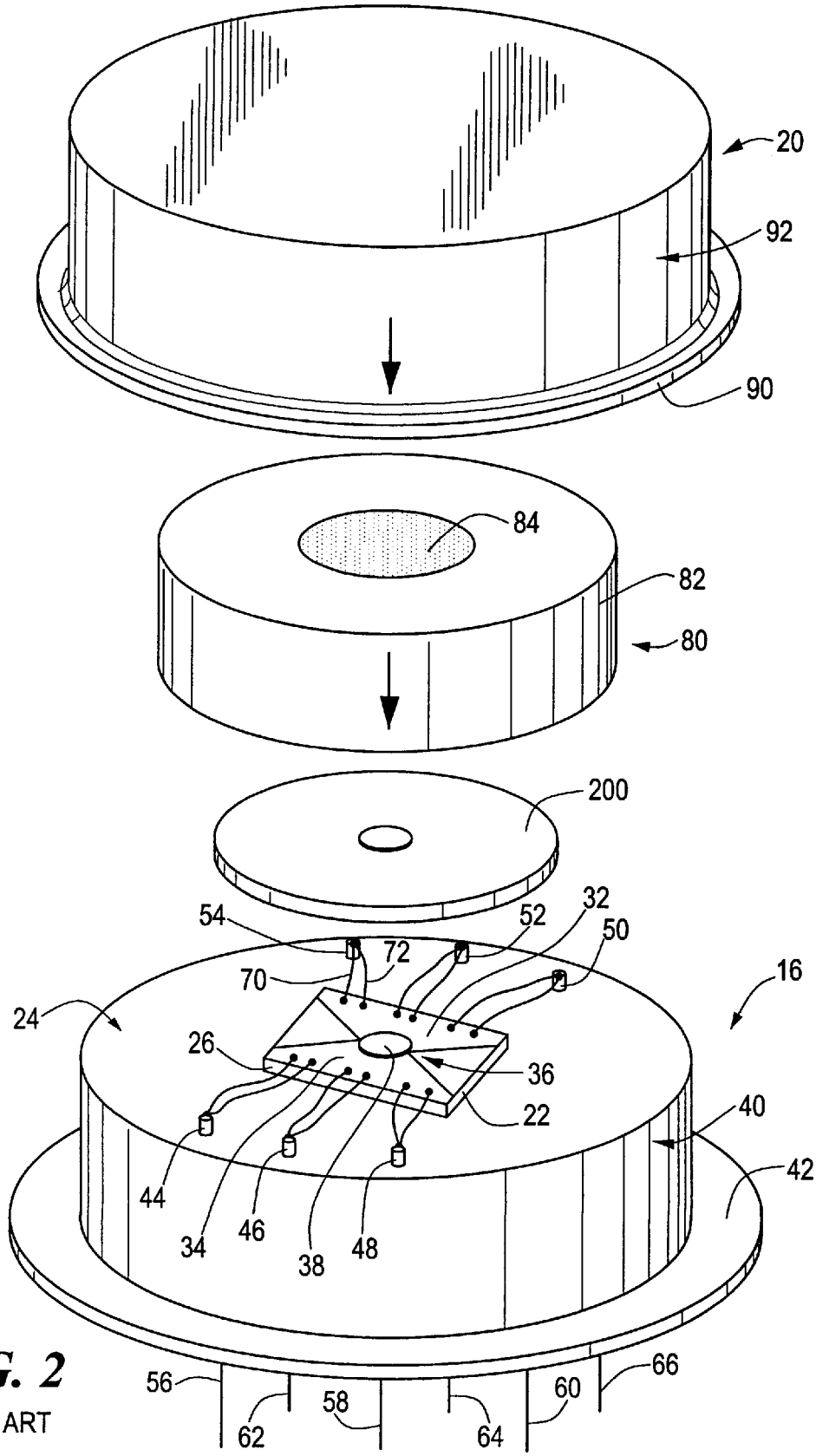
FIG. 2 PRIOR ART
FIG. 2 is a schematic exploded view of a prior art detonator including a number of individual lead post connecting wires.

Prior art detonators of this type include chip slapper 22, FIG. 2 residing on support surface 24 of transistor base 16. Chip slapper 22 includes chip base 26 made of an insulating material, usually ceramic. Conductive copper lands 32 and 34, deposited on base 26, are separated by or joined by narrow bridge portion 36. Flying plate 38 (e.g. a piece of polyimide) is secured over bridge portion 36. Base 16 also includes header wall 40, flange 42, and lead contact posts or pins 44, 46, 48, 50, 52, and 54 rising above support surface 24. The lead posts may alternatively extend through the side of base 16. Lead posts 44, 46, and 48 terminate in lead wires 56, 58, and 60, respectively, while lead posts 50, 52, and 54 terminate in lead wires 62, 64, and 66, respectively. There may be more or fewer lead posts and extending leads (see leads 18, FIG. 1) depending on the specific design but in general there are usually two sets of opposing lead posts or pins on opposite sides of chip slapper 22 secured to surface 24. One set of lead posts is adjacent one conductive land of the chip slapper and the other set of lead posts is adjacent the other conductive land. Additional sets of lead posts or pins could be used for other functions such as a four-wire measurement of the bridge resistance.

An electrical connection must be made between these lead posts and the conductive lands. In accordance with the prior art, this electrical connection is made via individual wires 70 and 72 interconnecting lead post 54 with conductive land 32. One end of each wire is usually bonded to lead post 54 and the other end of each wire is bonded to land 32. Individual wires also interconnect the other lead posts to the conductive lands as shown in FIG. 2.

As discussed in the background of the invention above, these individual wires tend to break in the harsh and often violent environment in which the detonator is used, and they are susceptible to burning under the application of high amperage current applied to, for example, lead wire 62. Moreover, bonding each wire entails a considerable amount of man hours. Indeed, to provide redundancy, there are usually at least two and sometimes more wires for an individual lead post as shown by wires 70 and 72 interconnecting lead post 54 with land 32. The redundant wires may help avoid the breakage and burning problems but they add to the complexity of the design and the additional man hours required to interconnect each wire.

Explosive charge 80 including optional metal sleeve 82 housing explosive 84 is then oriented such that there is an exact and proper spacing between flying plate 38 and explosive 84. In the prior art, this is usually accomplished by using mechanical spacer 200 disposed between support surface 24 of base 16 and explosive charge 80. Some designs have the spacer built into the chip slapper. Transistor can 20 is placed over this assembly and rim 90 of circular enclosure wall 92 is welded to disc shaped flange 42 of base 16. Besides the exact spacing of flying plate 38 with respect to explosive charge 84, another important design consideration is that explosive charge 84 must be in intimate contact with the interior top surface of can or cap 20. To meet this requirement, the prior art incorporated a number of spacers and resilient members discussed in more detail with reference to FIG. 6.

To initiate detonation, a high amperage electrical current is applied, for example, to lead wires 56, 58, and 60 in electrical contact with lead posts 44, 46, and 48. Narrow bridge portion 36 between or interconnecting opposing conductive lands 34 and 32 cannot withstand high amperage current and thus clip slapper 22 bursts and sends flying plate 38 to strike explosive charge 80 which, in turn, explodes thereby detonating main explosive 14, FIG. 1.

Figure 3:
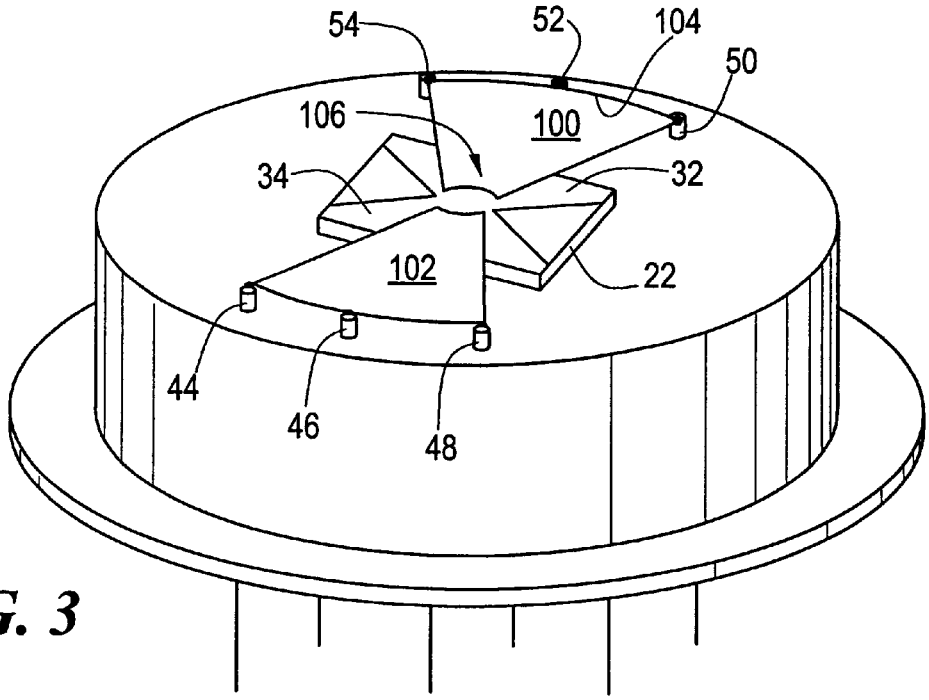
FIG. 3 is a schematic view of the base portion of the detonator in accordance with this invention.

In accordance with the subject invention, electrical connecting wires such as wires 70 and 72, FIG. 2 are replaced with some kind of a conductive surface, for example robust conductive plates 100 and 102, FIG. 3 extending between lead posts 44, 46, and 48 and land 34; and between lead posts 50, 52, 54 and conductive land 32, respectively. Conductive plates 100 and 102 are preferably made of copper or some other conductive material and are in the shape of an annular sector, as shown, each including broad distal end 104 which simultaneously covers lead posts 50, 52, and 54. Broad distal end 104 tapers to proximal end 106 connected to land 32 of chip slapper. Conductive plate 102 is of a similar construction but oriented to interconnect lead posts 44, 46 and 48 to land 34.

Figure 4:
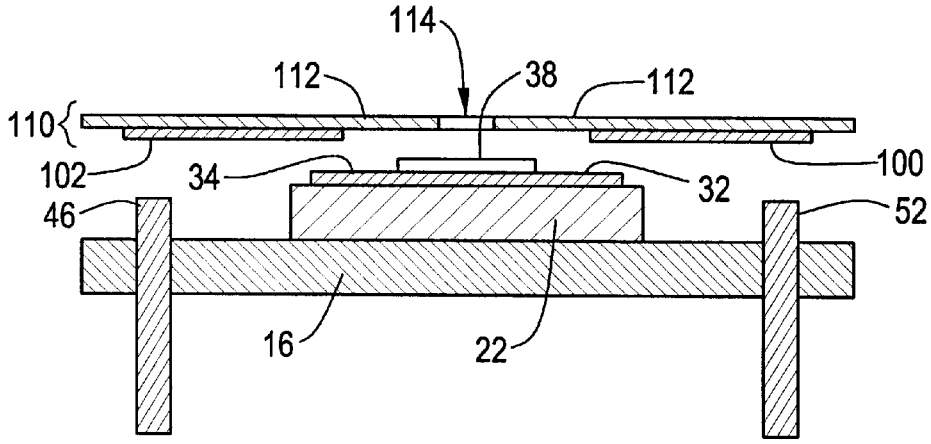
FIG. 4 is a side sectional partially exploded view of a preferred embodiment of the connecting barrel of this invention.
Figure 5:
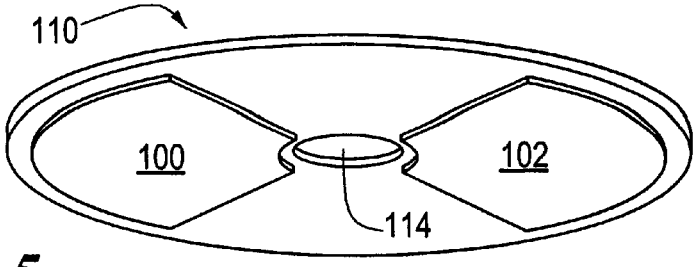
FIG. 5 is a schematic three dimensional view of the bottom portion of the connecting barrel shown in FIG. 4.

Conductive copper plates 100 and 102 are preferably part of laminated connecting barrel 110, FIGS. 4 and 5 which includes top insulating layer 112 and a bottom conductive layer configured into conductive plates 100 and 102. In this embodiment, barrel 110 is in the form of a laminate including an insulating layer made of polyimide such as the "Kapton" product available from DuPont, Inc., and a conductive copper layer. Insulating layer 112 shields lands 32 and 34, FIG. 3 from electrical contact with explosive charge 80, FIG. 6. In some cases, insulating layer 112 may be eliminated. The copper layer is preferably etched away in certain areas forming conductive plates 100 and 102. Then, opening 114 is formed to be placed over the bridge portion and flying plate 38 of chip slapper 22 so that nothing interferes with its travel to the explosive charge. The opening may extend through both the top insulating layer 112 and separate conductive plates 100 and 102 or, depending on the thickness of insulating layer 112, may simply separate conductive plates 100 and 102 and not extend through insulating layer 112.

Figure 6:
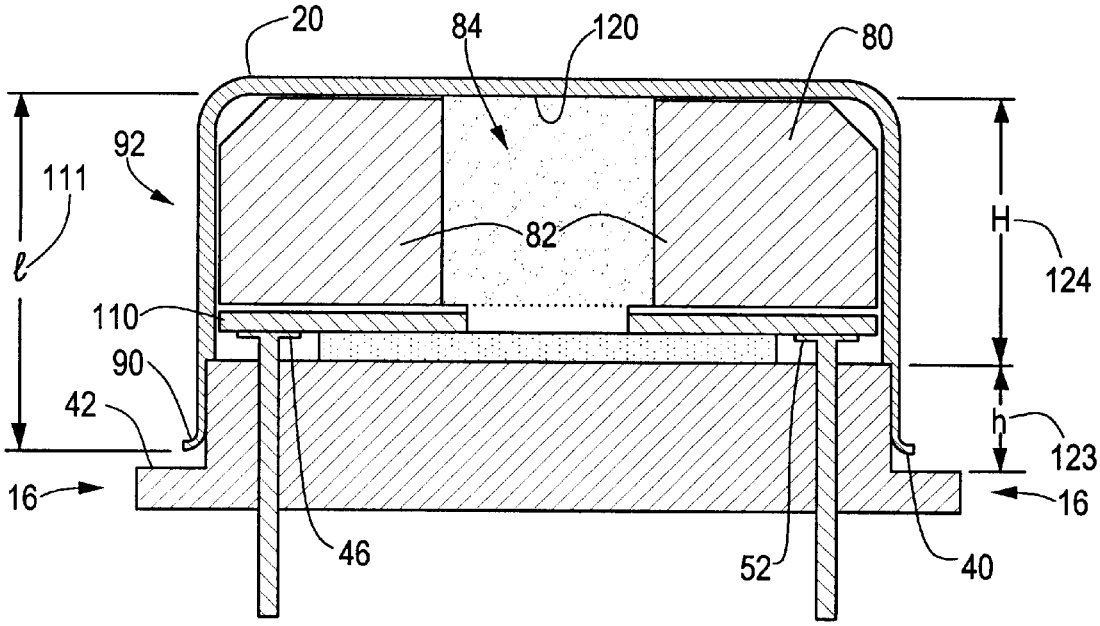
FIG. 6 is a schematic side sectional view of the complete detonator assembly of the subject invention.

The thickness of barrel 110 is selected to optimize the spacing between chip slapper, FIG. 6 and explosive component 84 of explosive charge 80. Thus, barrel 110 acts not only as the electrical connection between the contact posts of the detonator base and the lands of the chip slapper, but also simultaneously acts as a spacer between chip slapper 22 and explosive charge 80 to ensure that flying chip 38 travels the correct distance before striking explosive 84. This dual purpose function of barrel 110 eliminates fragile wire connections 70 and 72, FIG. 2 and mechanical spacer 200 of the prior art design. If other initiators besides chip slapper 22 are used in a detonator of a specific design, barrel 110 may be modified accordingly. For example, chip slapper 22 could be a microclad slapper or any other type of slapper device.

In order to ensure that explosive charge 84, FIG. 6 is in intimate contact with interior top surface 120 of cap or can 20 in light of the loose tolerances and thus varying lengths l, 111 of enclosure wall 92 of can 20 and varying heights h, 123 of header wall 92 of base 16 (common in the manufacturing of standard, low cost transistor bases and cans), the length 111 of can 20 is selected such that the thickness of chip slipper 22 and the thickness of explosive charge 80 when combined with the thickness of barrel 110 has a height H, 124 sufficient to ensure that rim 90 of cap 20 does not engage flange 42 of base 16.

In other words, loose manufacturing tolerances which lead to variable height (h) header walls 40 and variable length (l) can enclosure walls 92 are rendered irrelevant by the subject invention because rim 90 of enclosure wall 92 is not constrained to be welded to flange 42 and instead may be secured at any location along header wall 40 corresponding to the height (H) of chip slapper 22, barrel 110, and charge 80 at the same time ensuring that explosive charge 80 is in communication with interior top surface 120 of cap 20 so long as the following mathematical relationship is satisfied:

$$H<l<H+h \tag{1}$$

For example, if H is 0.200 inches (barrel 110 being 0.010 inches thick, chip 22 being 0.030 inches thick, and charge 80 being 0.160 inches thick which are typical values) and h, the height of header wall 40 is 0.045 inches (also a typical value) then l, the length of enclosure wall 92 can range from about 0.210 to 0.230 inches.

The subject invention thus uniquely takes into account the varying sizes of available explosive charge components 80, the thickness of a currently available chip slapper components 22, and the wide range in manufacturing tolerances related to header wall 40, and the length l of enclosure wall 92 of standard transistor TO type packages. Thus, l, H, and h can vary somewhat due to loose manufacturing tolerances but the subject invention renders these loose tolerances irrelevant.

Figure 7:
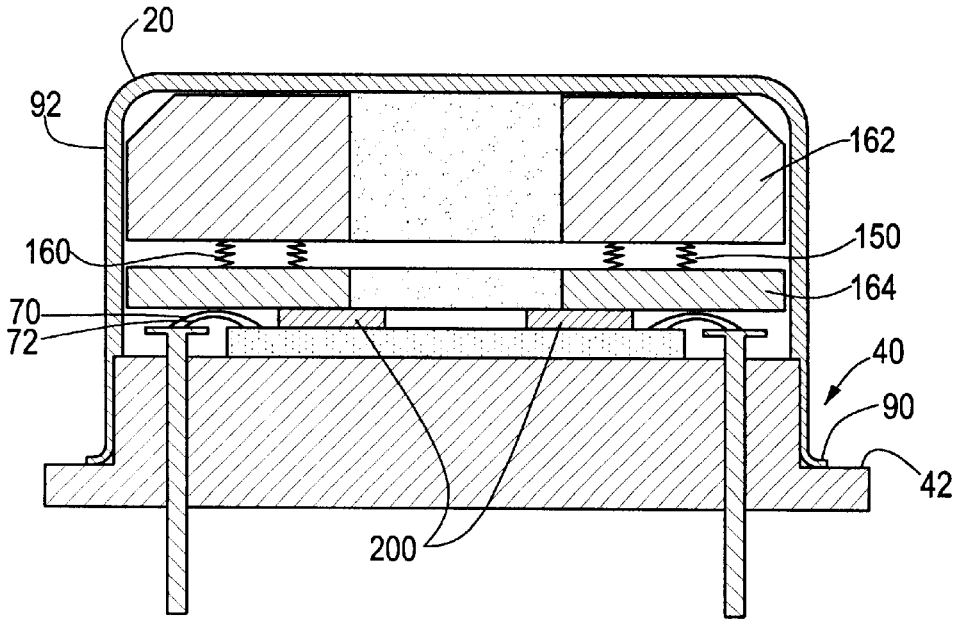
FIG. 7 PRIOR ART
FIG. 7 is a schematic side sectional view of a complete prior art detonator assembly.

In contrast, prior art devices incorporated a plurality of resilient members, conceptually represented by springs 150 and 160, FIG. 7 disposed between separate charges 162 and 164 in order to ensure that rim 90 of enclosure wall 92 can be forced down onto flange 42 and welded thereto.

In the subject invention, however, individual connecting wires 70 and 72 and spacer 200 are eliminated and their functions integrated in connecting barrel 110, FIGS. 4 and 5, which provides the dual function of interconnecting the electrical posts of the base portion with the lands of the EFI and properly spacing the flying chip of the EFI with respect to the explosive charge. Broad conductive plates 100 and 102, FIGS. 3, typically one mil thick, are electrically more efficient that wires 70 and 72, FIG. 7 since they incorporate more copper and thus offer lower resistance. Plates 100 and 102 are not susceptible to breakage like wires 70 and 72 thus providing a physically robust electrical interconnection. Indeed, even if the solder bond connecting conductive plates 100 and 102 to lead posts 46 and 52, FIG. 4 breaks, barrel 110 is constrained within transistor cap 20 and cannot move to any great extent. Thus, contact between conductive plates 100 and 102 and the lead posts is maintained due to barrel 110 being constrained within cap 20 between chip 22 and charge 80. Thus plates 100 and 102 will remain in electrical contact and extend between the electrical posts and the lands of the chip slapper even when subject to rapid acceleration and deceleration forces.

Finally, since rim 90, FIG. 6 of enclosure wall 92 is not constrained to engage flange 42 and instead can be welded at any number of locations along the height (h) of header wall 40, the need for resilient members 150 and 160, FIG. 7 is eliminated. In contrast, in the prior art, the length (l) of wall 92 is constrained to be exactly equal to the sum of the height h of header wall plus H, the total thickness of the components inside can 20. Since (l) and (h) often vary due to the low cost and loose manufacturing tolerances inherent in standard transistor components, the only way to force l to be exactly equal to the total of h plus H was to include resilient members such as springs 150 and 160, FIG. 7 to thereby render h variable resulting in an extraordinary amount of extra design and manufacturing considerations including, inter alia, the use of two explosive charges 162 and 164 separated by resilient members 160 and 150.

Assembly of detonator 16, FIG. 6, is accomplished by first fabricating barrel 110, FIG. 5. The copper layer of polyimide copper laminate is etched from the polyimide layer to form conductive plates 100 and 102. Opening 114 is then punched through the polyimide layer. Chip 22, FIG. 6 is then placed on the support surface of a standard TO base and secured thereto with an epoxy, adhesive, etc. Barrel 110 is then placed over chip 22 such that the broad distal ends of each conductive plates contact all of the adjacent lead posts of the base and the tapered proximal ends contact the lands of the chip. Solder, anisotropically conductive adhesives, conductive epoxies, and other similar conventional technologies can be used to provide the connection between the conductive plates and both the lands of the chip and the lead posts of the transistor base. Explosive charge assembly 80 is then placed directly on top of barrel 110 and cap or can 20 is placed over all of these interior components thus enclosing them. Rim 90 of cap 20 is then welded (e.g. using a YAG laser) at the appropriate location along the height of header wall 40 by laser welding such that inside the top surface 120 of can 20 is in intimate contact with explosive material 84 of explosive charge 80.

The result is a physically robust detonator able to withstand even violent environmental conditions housed in standard, loose tolerance, inexpensive transistor packages. The detonator of this invention is easier to fabricate than prior art detonators because there is no need for wires, spacers, or resilient devices.

Connecting barrel 110, FIGS. 4, 5, and 6 simultaneously provides the proper spacing between flying plate 38, FIG. 6 and explosive charge 80 (eliminating the need for mechanical spacer 200, FIG. 7). Conductive plates 100 and 102, FIGS. 3 and 5 are broad enough to cover all the lead posts on the base and long enough to cover the span between the lead posts and the lands of the chip slapper thereby eliminating fragile wires 70, 72, FIG. 7 used in the design of prior art detonators.

Although specific features of this invention are shown in some drawings and not others, this is for convenience only as each feature may be combined with any or all of the other features in accordance with the invention.

Other embodiments will occur to those skilled in the art and are within the following claims:

What is claimed is:

1. A detonator comprising:

a base portion including a support surface without any contact pads but discrete electrical leads extending upwards from the support surface;

an exploding foil initiator on the support surface, the exploding foil initiator including at least two conductive lands separated by a bridge portion therebetween and a flying plate on the bridge portion;

a connecting barrel of a predetermined thickness on the exploding foil initiator and the upwardly extending electrical leads for optimizing the spacing between the exploding foil initiator and an explosive charge and for robustly interconnecting the lands of the exploding foil initiator with the electrical leads extending upwards from the support surface, the connecting barrel including:

a thin; insulative substrate;

a plurality of conductive surfaces on the insulative substrate, the conductive surfaces extending between the upwardly extending electrical leads and the lands of the exploding foil initiator; and an opening located over the bridge portion of the exploding foil initiator.

2. The detonator of claim 1 in which the conductive surfaces are formed by etching away a conductive layer from selected portions of the insulative substrate.

3. The detonator of claim 2 in which the opening in the conductive surface of the barrel extends through the insulative substrate.

4. The detonator of claim 2 in which the insulative substrate is polyimide and the conductive surfaces are copper.

5. The detonator of claim 1 in which the conductive surfaces include at least one plate having the shape of an annular sector.

6. The detonator of claim 1 in which the conductive surfaces each have a broad distal end for simultaneously covering a plurality of leads on one side of the support surface and a tapered proximal end connected to a land of the exploding foil initiator.

7. The detonator of claim 1 in which the conductive surfaces form two conductive plates separated by the opening.

8. The detonator of claim 1 in which the base portion includes a header wall terminating in the support surface, and the connecting barrel is disposed between the exploding foil initiator on the support surface and an explosive charge; the detonator further including:

a cap having an interior top surface and an enclosure wall extending downward from the interior top surface and surrounding the exploding foil initiator, the barrel and the explosive charge, the enclosure wall terminating in a rim secured at a location along the header wall depending on the thickness of the exploding foil initiator, the thickness of the barrel, and the thickness of the explosive charge thereby ensuring that the explosive charge is always in contact with the interior top surface of the cap despite manufacturing intolerances.

9. The detonator of claim 8 in which a laser weld secures the rim of the cap to the header wall.

10. The detonator of claim 1 in which the base portion is a round TO type transistor header.

11. The detonator of claim 8 in which the cap is a round TO type transistor can.

12. The detonator of claim 1 in which the base portion has a header wall of height h terminating in the support surface, the exploding foil initiator resides on the support surface, the connecting barrel is disposed between the exploding foil initiator and an explosive charge, the thickness of the exploding foil initiator, the explosive charge, and the barrel totaling a height H, the detonator further including:

a cap having an interior top surface and an enclosure wall of length l extending downward from the interior top surface and surrounding the exploding foil initiator, the barrel and the explosive charge, the enclosure wall terminating in a rim, the length of the enclosure wall l being greater than the height H and less than the sum total of H and the height of the header wall h such that the rim of the enclosure wall is securable at a location along the header wall.

13. A method of manufacturing a detonator, the method comprising:

securing an exploding foil initiator on a base portion including sets of discrete electrical lead posts extending upwards from the base portion without any contact pads, the exploding foil initiator including two conductive lands separated by a bridge portion therebetween and a flying plate on the bridge portion;

fabricating a connecting barrel having an insulating layer of a predetermined thickness with two conductive plates separated by an opening; and placing the connecting barrel on the exploding foil initiator and over the lead posts such that the two conductive plates of the barrel each interconnect a set of electrical lead posts of the base portion with a conductive land of the exploding foil initiator.

14. The method of claim 13 further include disposing an explosive charge on the connecting barrel and placing a cap over the explosive charge, the barrel, and the exploding foil initiator.

15. The method of claim 13 in which the fabrication step includes providing a laminate having a conductive layer and said insulating layer and etching the conductive layer from selected portions of the conductive layer.

16. The method of claim 15 in which etching includes forming conductive plates each having the shape of an annular sector.

17. The method of claim 13 further including forming the opening to extend completely through the barrel.

* * * * *